United States Patent [19]

Bohacek

[11] Patent Number: 4,620,340

[45] Date of Patent: Nov. 4, 1986

[54] MOP-WRINGING DEVICES

[75] Inventor: Jan Bohacek, Lower Kingswood, England

[73] Assignee: Jani-Jack Limited, Surrey, England

[21] Appl. No.: 727,829

[22] Filed: Apr. 26, 1985

[30] Foreign Application Priority Data

Apr. 27, 1984 [GB] United Kingdom ..... 8410892

[51] Int. Cl.[4] ..... A47L 13/146

[52] U.S. Cl. ..... 15/261

[58] Field of Search ..... 15/260, 261; 68/241

[56] References Cited

U.S. PATENT DOCUMENTS

| | | | |
|---|---|---|---|
| 868,799 | 10/1907 | McNeal | 15/261 |
| 1,486,284 | 3/1924 | Eiffe | 15/261 |
| 1,486,285 | 3/1924 | Eiffe | 15/261 |
| 1,500,058 | 7/1924 | Courtemanche | 15/261 |
| 4,047,261 | 9/1977 | Rones | 15/261 |

FOREIGN PATENT DOCUMENTS

| | | | |
|---|---|---|---|
| 768304 | 5/1934 | France | 15/261 |

*Primary Examiner*—Chris K. Moore

*Attorney, Agent, or Firm*—Cushman, Darby & Cushman

[57] ABSTRACT

A mop-wringing device has a main frame with a fixed lower support plate and a displaceable upper pressure plate. A toggle link mechanism pivots the pressure plate downwards about a rear edge pivot connection to squeeze water from a mop head placed between the two plates. The mechanism comprises a torque bar mounted below the support plate and C-form lever arms secured at one end to the bar and connected at the other end to the pressure plate through toggle links. The arrangement allows a wide opening of the plates and a high wringing pressure on the mop head. The pivot connection of the pressure plate comprises upwardly elongate slots for end pivot pins, whereby the pressure plate can tilt to a limited degree to adapt to the thickness of the mop head.

10 Claims, 5 Drawing Figures

MOP-WRINGING DEVICES

BACKGROUND OF THE INVENTION

This invention relates to devices for wringing mops. It is particularly concerned, but not necessarily exclusively so, with devices for wringing mops of the kind which comprise a pad, which is usually provided with tufts of water-absorbent material, mounted on a generally planar frame.

Devices are known for wringing such mops that comprise a pair of mutually pivoted plates between which the mop head is placed and excess moisture wrung from it as the plates are pivoted together to apply pressure to the mop head. The known devices have the disadvantage that they remove water unevenly from different regions of the mop head because the gap between the plates is greater the further the distance from the hinge pivot, so that there may be little or no pressure applied to that part of the mop head remote from the pivot.

Devices are also known in which two plates are held horizontally one above the other, allowing a mop head to be placed between them, and a gear rack mechanism is employed to lower the upper plate and wring moisture from the mop head squeezed between the plates. The gear rack mechanism is expensive to construct, however, and the device is difficult to use because the conventional long-handled mop is cumbersome to manipulate and the mop head has to be inserted sideways; moreover the space receiving it is largely obscured from the view of the user by the raised upper plate. A further characteristic of this device is that the mechanism maintains the upper and lower plates parallel, which can lead to an uneven wringing effect analogously to the other known form of device referred to above.

In both the known forms of device mentioned, some restriction of the maximum opening between the plates is necessary in order to be able to close the plates together by one hand while the mop is being held by the other hand.

SUMMARY OF THE INVENTION

According to one aspect of the present invention, there is provided a mop-wringing device having a main frame comprising a support plate, a pressure plate being displaceable on said frame to be brought to a closed position adjacent the support plate to press excess moisture from a mop head inserted between the plates, the pressure plate having a pivot joint connection with the main frame for opening a gap between the plates to insert the mop head, said connection also having freedom for limited displacement of the pressure plate at the joint towards and away from the support plate, whereby the connection permits tilting of the pressure plate to adopt a spacing from the support plate adjacent the connection determined by the thickness of the mop head adjacent the pivot.

According to another aspect of the invention, there is provided a mop-wringing device comprising a support plate fixed in a main frame and a pressure plate pivotably displaceable towards the support plate about an axis adjacent an edge of the pressure plate to press excess moisture from a mop head inserted between the plates, the pivoting displacement of the pressure plate also permitting limited movement of the pivoting axis of the pressure plate towards and away from the support plate, operating means for said displacement of the pressure plate comprising toggle link means that move towards an over-centre position to displace the pressure plate so as to apply pressure to an inserted mop head.

According to a further aspect of the invention, there is provided a mop-wringing device comprising a support frame that includes a generally horizontally extending support plate, a pressure plate displaceably mounted on the frame above said support plate and having an operating mechanism to move it between open and closed positions with respect to said support plate, in said open position the pressure plate being spaced away from the support plate for insertion of a mop head between the plates and in said closed position the pressure plate being brought close to the support plate to apply pressure to the inserted mop head to wring the excess moisture therefrom, said operating mechanism for the pressure plate comprising toggle link means extending upwards from the top of the pressure plate and lever means connected to the upper end of said toggle link means and to the support frame respectively, the support frame pivot connection being located below the pressure plate and the lever means extending rearwardly and downwardly from said pivot connection with the toggle link means to said support frame pivot connection, the arrangement being such that by pivoting of the lever means to move the toggle link means towards an over-centre position the pressure plate is brought to said closed position, and that by pivoting the lever means in the opposite direction, the pressure plate is moved to the open position in which it is vertically clear of substantially the whole of a mop-wringing area of the pressure plate.

The invention will be described in more detail by way of example with reference to the accompanying drawings.

DESCRIPTION OF THE PREFERRED EMBODIMENT

The illustrated device is intended for squeezing excess moisture from a generally flat mop head, that may comprise a tufted fabric cover held on a planar frame. Examples of such a mop head and frame are described in more detail in UK Pat. Nos: 1604448 and 2035064.

The wringing device comprises a main frame formed by a pair of side plates 2 connected together rigidly by a flanged transverse angle plate 4 and by a trough-like perforated support plate 6 on the generally flat bottom of which the mop head (not shown) can be placed. At its front and rear the plate has respective inclined margins 10, 12 terminating in reinforcing flanges. These margins 10, 12 are inclined relatively steeply, approximately 50°–70° to the flat bottom of the plate.

Figure 1:
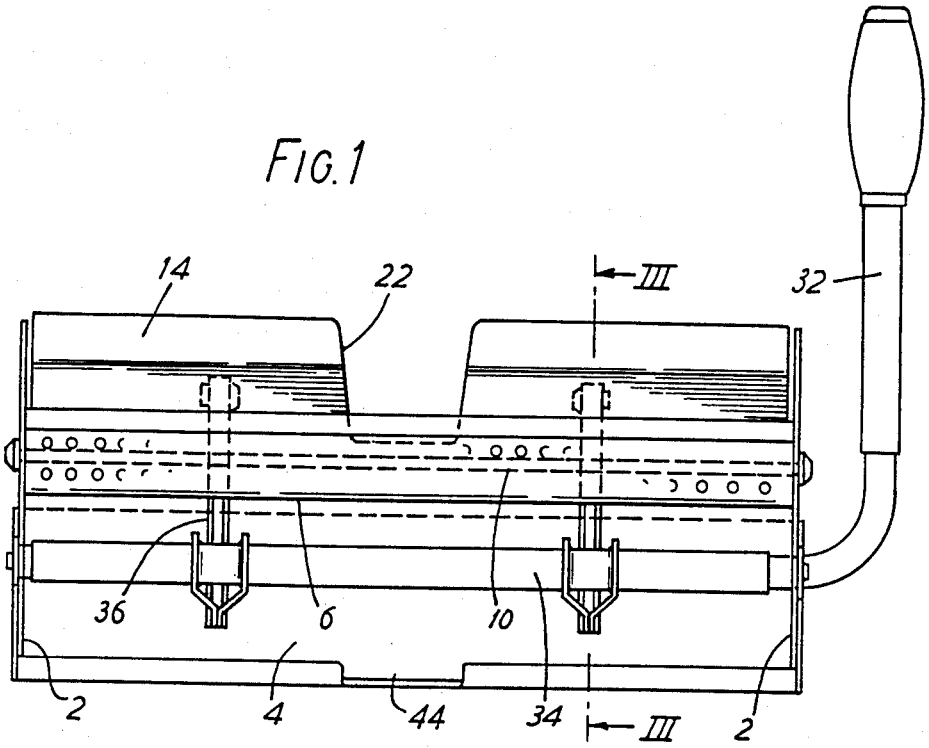
FIGS. 1 and 2 are front and plan views respectively of a mop-wringing device according to the invention for a flat mop head, FIG. 1 illustrating the pressure plate partly raised and FIG. 2 illustrating it fully raised.
Figure 2:
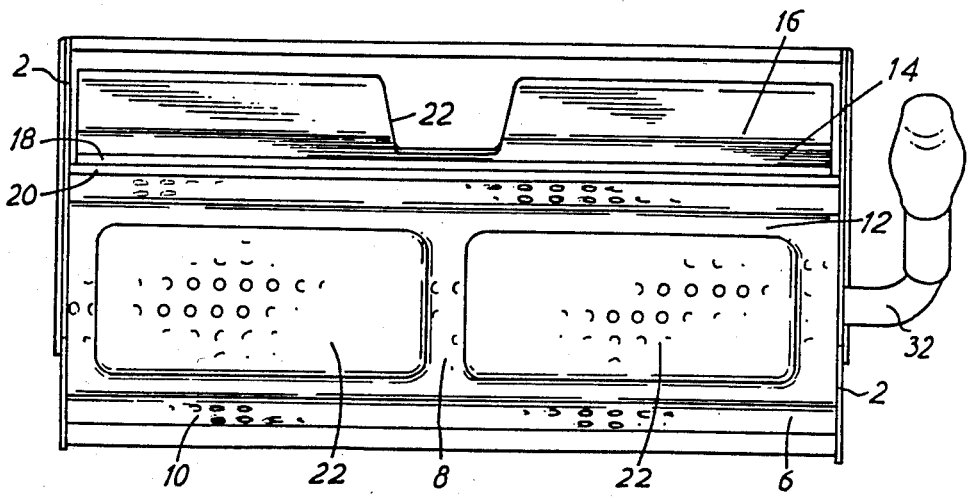
Figure 3:
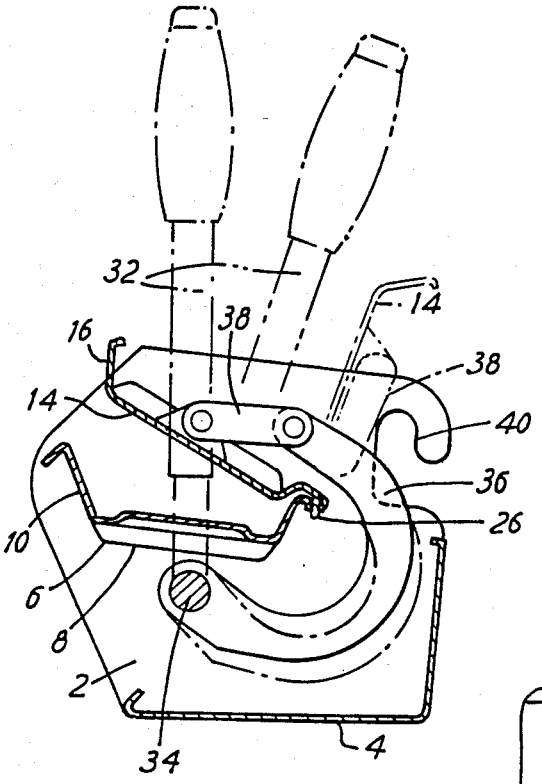
FIG. 3 is a cross-section on the line III—III in FIG. 1 illustrating the pressure plate in the partly raised position of FIG. 1 and in the fully raised, open position.

A pressure plate 14 is mounted in the frame above the support plate 6, generally coextensive with the support plate. The side profile of the pressure plate is similar to that of the support plate, with a flat main face and inclined front and rear margins 16, 18. At its rear edge beyond the inclined margin 18 the pressure plate has a flanged lip 20. As shown in FIG. 3, the pressure plate is displaceable between a raised position, in which it extends substantially vertically from adjacent the rear edge of the support plate to allow a mop head to be placed on the support plate, and a lowered position in which its main planar face lies close to and substantially parallel with the base of the support plate in order to apply wringing pressure to the mop head inserted onto the trough-like plate 6. It may be noted that because of the inclination of the front and rear margins of the plates the gap between them also narrows, so that any fringes of the mop head lying in these margins may also be wrung out.

To provide clearance for the pivot joint connection between the head and handle of the mop, the pressure plate also has a central cut-out 22 in its front region forming an open recess that extends some half way across the width of the plate from its inclined front edge. To either side of the cut-out the pressure plate has raised areas 22 to apply a more effective squeezing action to the main moisture-carrying areas of the mop head.

Figure 4:
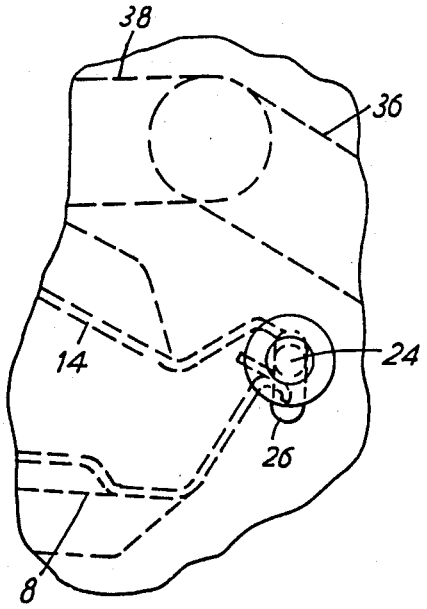
FIG. 4 is an end view to a larger scale illustrating the pivot point connection of the pressure plate.

For the movement between the open and closed positions, the pressure plate 14 is articulated to the main frame through a pivot joint at its flanged rear edge comprising pins 24 projecting from opposite side edges of the plate to engage in apertures 26 in the side plates 2, these apertures being in the form of elongated slots (best seen in FIG. 4) extending substantially perpendicular to the support plate.

The pressure plate is displaced by a lever mechanism comprising a hand lever arm 32 fixed on a torque tube 34 mounted in the side plates 2 below the support plate 6. Also fixed to the pivot shaft are C-shaped lever arms 36 that extend round the rear and over the top of the support plate to be connected to the pressure plate 14 by respective links 38 pinned to brackets 40 on the plate. Each lever arm 36 and link 38 is composed of a pair of sheet-metal parts spot-welded together to form rigid linkage elements, each arm and link pair being symmetrical about a central plane to avoid large out-of-plane bending forces from the considerable loads that are applied to wring a mop head.

In the open position shown in FIG. 3, the pivot links 38 held in the lever arms 36 extend behind the pressure plate pivot joint 24. 26 and the links have drawn the pressure plate 14 upwards away from the support plate to be disposed substantially at right-angles to the support plate and at a considerable spacing therefrom, even adjacent the pivot joint, so giving open access to the main flat area of the support plate. The pivot pins 24 lie at the bottom of their apertures. When the mop head is placed in the plate, the hand lever arm 32 is drawn forwards and the lever arms 36 are thereby thrust forwards and upwards, the interconnected links 38 swinging the pressure plate down towards the support plate. In the final stage of this movement, the links extend substantially radially to the pivot shaft 34 and their pivot connections to the C-shaped lever arms are moving substantially parallel to the two plates 6, 14. The lever arms 28 and links 30 thereby act as a toggle mechanism and are able to apply a large pressure to the inserted mop head for a small force on the hand lever arm 24.

Figure 5:
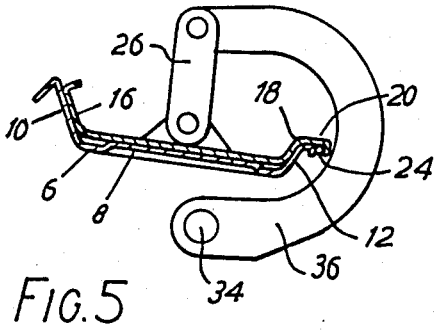
FIG. 5 is an end view illustrating the closed position.

During the closing movement, the pressure plate has a degree of float about the pivot connections with the links, due to the elongation of the rear edge pivot apertures 26, which allows the pins 24 to move upwards in the apertures in dependence upon any variation of thickness of the trapped mop head so that pressure is applied relatively evenly over the area of the head. Preferably, when the plates 6, 14 are parallel and in contact as is shown in FIG. 5, the pins 24 are intermediate the height of their slots 26. Either the front or rear edge of the pressure plate is thus able to tilt to a limited degree as it closes on a mop head depending on whether the mop head tufts lie thickest at the front or the rear of the support plate, and it will be appreciated that some lateral tilting is also permitted if the mop head tufts lie thicker at one side than the other.

Preferably, the closing movement of the device reaches its end limit position before the dead-centre position of the links is attained, as will be clear from FIG. 5. In this way, when the forward pressure on the hand lever arm is released the restoring forces will urge the plates 6, 14 open and it is not necessary to apply a force to pass through the dead centre position to release the mop head.

It is also preferably arranged that the gravity forces on the mechanism assist the opening movement (after the toggle links have returned through their dead-centre positions radial to the pivot shaft 34 if the toggle mechanism is able to move over centre) so that the device will have a stable open position, making easier the insertion and removal of a mop head. It will be clear from the drawings that this effect can be easily achieved with the form of operating mechanism employed.

The side plates of the device are provided with upwardly directed slots 40 to allow the device to be mounted on a cross-bar of a carrier (not shown) which will also have a container below the device to receive moisture wrung from the mop head. The main frame is so arranged that when in position on the carrier the bottom wall of the angle plate 4 is inclined slightly downwards towards its front so that water falling onto it will drain away through gap 44 in its front flange.

The toggle mechanism can be so arranged as to set a minimum gap between the plates 6, 14 that is independent of the amount of force applied to the lever arm 32. In this form, the device is particularly suitable for wringing a mop so as to ensure that a limited amount of moisture is left in the mop head. The mop can then be used damp to pick up dirt more effectively, without carrying excess moisture that would be left on the surface being cleaned. It will be understood that such a method of limiting the amount of liquid retained by the mop head can also be used to control the application of a surface treatment.

A wringing device according to the present invention is not limited to use in such methods. It can be arranged to remove a greater proportion of the moisture in a mop head, and, of course, it can be adapted for use with mops other than the flat-headed form of mop referred to above.

I claim:

1. A mop-wringing device having a main frame comprising a support plate, a pressure plate displaceable on said frame to press excess moisture from a mop head inserted between the plates, operating means for displacing the pressure plate between a closed position adjacent the support plate and an open position further spaced from said plate, connection means between the pressure plate and the frame providing a pivoting axis adjacent an edge of the pressure plate, the pressure plate being pivotable by the operating means about said connection to open a gap between the two plates, said connection also permitting limited movement of the pivoting axis of the pressure plate towards and away from the support plate, said operating means comprising an operating member and toggle link means connecting said operating member to the pressure plate, said toggle link means being moved towards an over-centre position by movement of said operating member for displacing the pressure plate to apply pressure to an inserted mop head.

2. A device according to claim 1 wherein said frame comprises opposite side plates, the pressure plate extending between and being secured to said side plates, said pivot connection between the pressure plate and the frame comprising pivot projections and elongate slots receiving said pivot projections, of said pivot projections and elongate slots the one being on the end plates and the other on the pressure plate.

3. A device according to claim 1 wherein said connection means is located in the region of the rear edges of the pressure and support plates and the pressure plate is pivotable on said connection means through an angle of at least substantially 90° rearwardly and upwardly from the support plate.

4. A device according to claim 1 wherein the support plate has a trough-like form comprising a generally planar main portion and front and rear margins extending upwardly from said main portion.

5. A device according to claim 4 wherein the pressure plate has a main generally planar portion and front and rear upwardly extending margins conforming essentially to said trough-like form of the support plate to be disposed close thereto in the closed position.

6. A device according to claim 1 wherein said operating means comprises lever means connected to the pressure plate through said toggle link means.

7. A device according to claim 6 wherein the lever means comprise at least one member having upper and lower ends located above and below the support plate, between said ends the member extending rearwards of the support plate, the upper end of said member being connected to the pressure plate through said toggle link means and a pivot connection being provided on the frame for said lower end of the member.

8. A device according to claim 7 having a plurality of said lever means members connected to respective links of said toggle link means, said links having pivot axes on common axes, a torque tube being secured to the lower ends of said members and a hand lever being secured to the torque tube to operate said toggle link means.

9. A mop-wringing device having a main frame comprising a support plate, a pressure plate displaceably connected to said main frame, operating means for displacing said pressure plate between a closed position adjacent the support plate to press excess moisture from a mop head inserted between the plates, and an open position further spaced from said support plate, the connection between the pressure plate and the main frame comprising a pivot joint including a pivot element on the pressure plate, a further element of the connection on said main frame cooperating with said pressure plate element, said pivot connection providing freedom for limited displacement of the pressure plate at the connection towards and away from the support plate, whereby the connection permits tilting of said pressure plate in said closed position to adopt a spacing from the support plate adjacent the connection determined by the thickness of the mop head.

10. A mop-wringing device comprising a support frame, a generally horizontally extending support plate in the said support frame, a pressure plate located above said support plate and displaceably mounted on the support frame, an operating mechanism connected between the pressure plate and the support frame to move the pressure plate between open and closed positions with respect to said support plate, in said open position the pressure plate being spaced away from the support plate for insertion of a mop head between the plates and in said closed position the pressure plate being brought close to the support plate to apply pressure to the inserted mop head to wring the excess moisture therefrom, said operating mechanism for the pressure plate comprising toggle link means extending upwards from the top of the pressure plate and lever means having spaced pivot connections to the upper end of said toggle link means and to the support frame respectively, said support frame pivot connection being located below the pressure plate and the lever means extending rearwardly and downwardly from said pivot connection with the toggle link means to said support frame pivot connection, the arrangement being such that by pivoting of the lever means to move the toggle link means towards an over-centre position the pressure plate is brought to said closed position, and that by pivoting the lever means in the opposite direction, the pressure plate is moved to the open position in which it is vertically clear of at least substantially the whole of a mop-wringing area of the pressure plate.

* * * * *